US006773185B1

(12) United States Patent
Hsieh

(10) Patent No.: US 6,773,185 B1
(45) Date of Patent: Aug. 10, 2004

(54) RETRACTILE PEN

(76) Inventor: Ming-Jen Hsieh, No. 21, Sec. 3, Mu Hsin Rd., Wen Shan District, Taipei (TW)

( * ) Notice: Subject to any disclaimer, the term of this patent is extended or adjusted under 35 U.S.C. 154(b) by 0 days.

(21) Appl. No.: 10/609,580

(22) Filed: Jul. 1, 2003

(51) Int. Cl.[7] ..... B43K 24/02

(52) U.S. Cl. ..... 401/105; 401/104; 401/109; 401/114

(58) Field of Search ..... 401/104, 105, 401/109, 112, 113, 114, 117

(56) References Cited

U.S. PATENT DOCUMENTS 1,701,771 A * 2/1929 Coler-Dark ..... 30/162
2,500,979 A * 3/1950 Leslie ..... 401/114
6,276,855 B1 * 8/2001 Hsien ..... 401/114
6,309,122 B1 * 10/2001 Wang ..... 401/112

* cited by examiner

*Primary Examiner*—Gregory L. Huson
*Assistant Examiner*—Huyen Le
(74) *Attorney, Agent, or Firm*—Troxell Law Office PLLC

(57) ABSTRACT

A retractile pen has an outer barrel, an inner barrel movably located in the outer barrel, and a clip connected to a rear end of the outer barrel. The inner barrel has a retaining bolt elastically connected to a rear end thereof. A first and a second guide slot are correspondingly provided on the clip and the outer barrel. A push button is connected to the retaining bolt via a connecting bar downward extended from an expanded head straddling the first guide slot. When the push button is depressed and slid along the first guide slot, the inner barrel is moved to expose or retract a writing tip thereof from or into the outer barrel. When the writing tip is exposed, the push button locks a front end of the clip to remind a user of the exposed writing tip to avoid an ink-spotted pocket.

15 Claims, 7 Drawing Sheets

RETRACTILE PEN

FIELD OF THE INVENTION

The present invention relates to a retractile pen, and more particularly to a pen having a push button, by moving which along two guide slots correspondingly provided on a clip and an outer barrel of the pen, an inner barrel may be moved relative to the outer barrel to expose or retract a writing tip. And, when the writing tip is in the exposed position, the clip is locked by the push button to the outer barrel and a user is therefore reminded of the exposed writing tip to avoid making an ink spot on a pocket holding the pen.

BACKGROUND OF THE INVENTION

There are a variety of retracting structures designed for pens, so that the pens have an adjustable overall length. U.S. Pat. No. 6,276,855 B1 discloses a retractile pen, and Taiwanese New Utility Model Patent No. 136892 discloses a retractile pen having a retractable and rotatable barrel. The pens disclosed in these patents all have a barrel that may be shortened for conveniently positioning in a small pocket or extended for writing comfortably. There are also pens not provided with a cap but having a retractable writing tip that may be exposed for writing or retracted for storage. When a user clamps a retractile pen to a pocket without retracting the exposed writing tip, the exposed writing tip would undesirably make an ink spot on the pocket, and the ink spot is normally uneasy to remove.

SUMMARY OF THE INVENTION

A primary object of the present invention is to provide an improved retractile pen that would remind a user of an exposed writing tip before the pen could be clamped to a pocket with a clip of the pen, and therefore avoids an ink-spotted pocket.

To achieve the above object, the retractile pen of the present invention mainly includes an outer barrel, an inner barrel movably located in the outer barrel, and a clip connected to a rear end of the outer barrel. The inner barrel is provided near a rear end with a retaining hole having a retaining bolt elastically received therein. A first and a second guide slot are correspondingly provided on the clip and the outer barrel. A push button is connected to the retaining bolt via a connecting bar downward extended from an expanded head straddling the first guide slot. When the push button is depressed and slid along the first guide slot, the inner barrel and accordingly a writing tip at a front end thereof are brought via the engaged retaining bolt and connecting bar to extended from or retracted into the outer barrel. When the inner barrel is in the extended position and the writing tip is exposed from the outer barrel, the push button located at a front end of the first guide slot locks the clip to the outer barrel and prevents the pen from clamping to a pocket with the clip, and therefore reminds a user of the exposed writing tip to avoid making any ink spot on the pocket.

According to the present invention, the push button movably located above the clip of the retractile pen may have dimensions and configuration specially designed to facilitate pushing or sliding of the push button by a user. Moreover, the push button may be provided with different patterns, letters, etc. to serve as advertising means.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
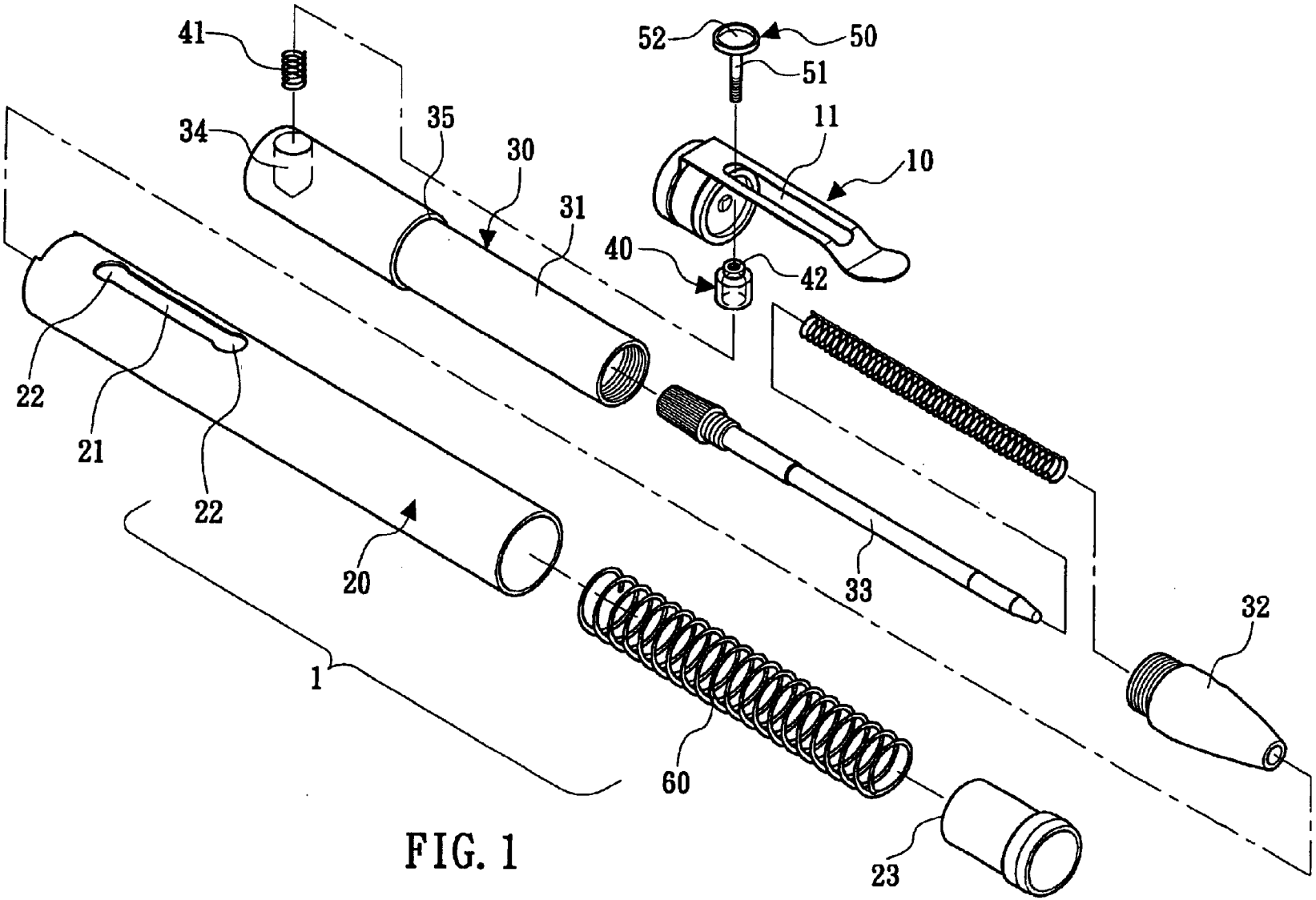
FIG. 1 is an exploded perspective view of a retractile pen according to a preferred embodiment of the present invention.
Figure 4:
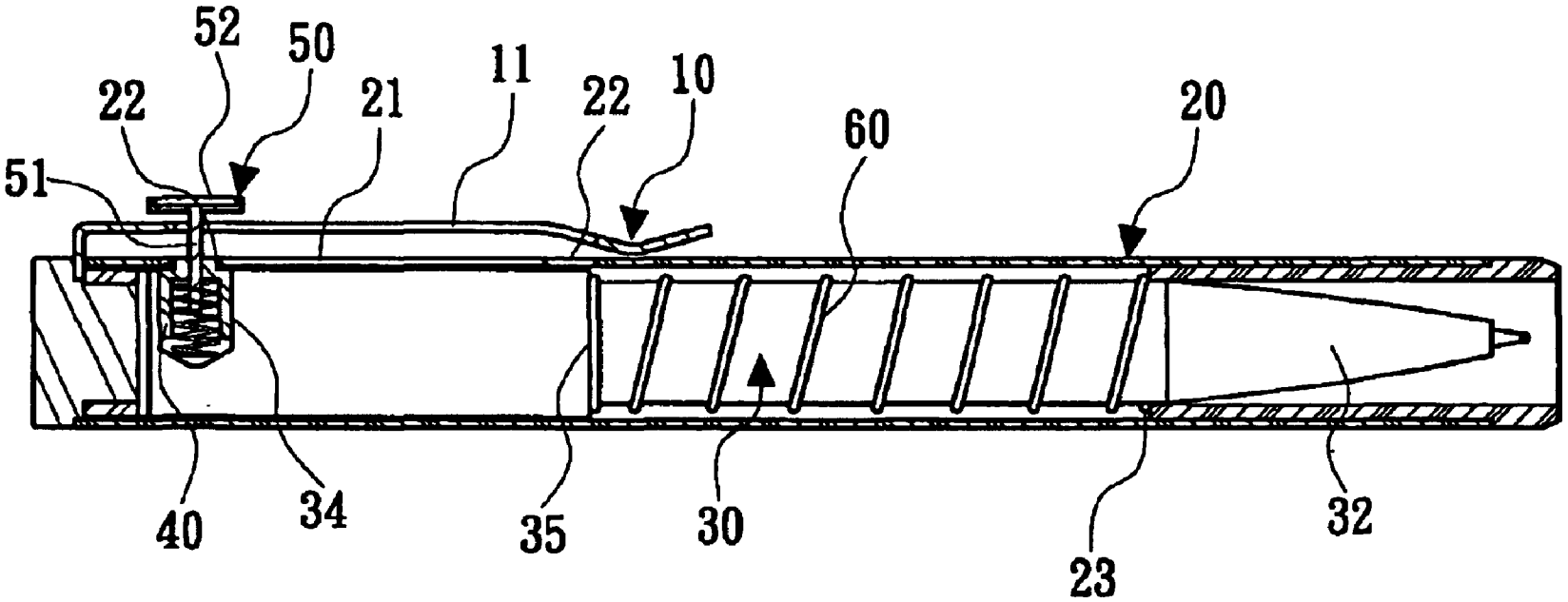
FIG. 4 is a partially sectioned side view of FIG. 2.

Please refer to FIGS. 1 and 4 that are exploded perspective and assembled sectioned side views, respectively, of a retractile pen 1 according to a preferred embodiment of the present invention. As shown, the retractile pen 1 mainly includes a clip 10, an outer barrel 20, and an inner barrel 30. The clip 10 is fixedly fitted to a rear end of the outer barrel 20, and the inner barrel 30 is movably received in the outer barrel 20. The inner barrel 30 includes a tube 31, a writing tip 32 connected to a front end of the tube 31, and an ink cartridge 33 mounted in the inner barrel 30 to expose a front point from the writing tip 32, and has an overall length smaller than the outer barrel 20.

The clip 10 is provided with a longitudinally extended first guide slot 11, and the outer barrel 20 is correspondingly provided with a second guide slot 21, two ends of which have an increased width to provide two locating slots 22. The tube 31 of the inner barrel 30 is provided near a rear end with a radially extended round retaining hole 34 having a predetermined diameter. A cylindrical retaining bolt 40 is received in the retaining hole 34 and normally pushed outward by a spring 41 positioned in the retaining hole 34 below the retaining bolt 40. The retaining bolt 40 has a stepped upper portion to provide a size-reduced stub 42. The size of the stub 42 corresponds to that of the two locating slots 22 at two ends of the second guide slot 21, so that the stub 42 may be projected into and held to the locating slots 22. A push button 50 having an expanded head 52 and a connecting bar 51 perpendicularly extended from a bottom center of the expanded head 52 is axially connected at the connecting bar 51 to the stub 42. The connecting bar 51 is first extended through the first guide slot 11 on the clip 10 before being extended into the stub 42, so that the expanded head 52 of the push button 50 is located above the clip 10 to straddle the first guide slot 11. In the illustrated embodiments of the present invention, the stub 42 is internally threaded, and the connecting bar 51 is externally threaded to screw to the stud 42.

A compression spring 60 is put on the tube 31 between a first shoulder portion 35 provided near the rear end of the tube 31 and a second shoulder portion 23 provided near a front end of the outer barrel 20. With these arrangements, the compression spring 60 is in a proper tensional state to keep the inner barrel 30 in the outer barrel 20 without easily shifting relative to the outer barrel 20. When the inner barrel 30 is moved forward in the outer barrel 20, the compression spring 60 is compressed to generate a backward restoring force.

Figure 2:
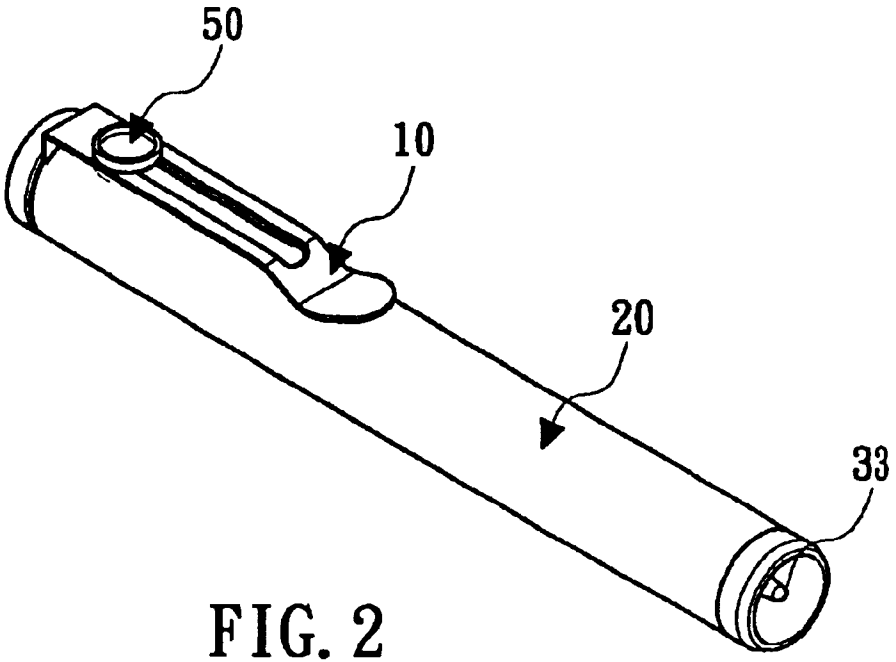
FIG. 2 is an assembled perspective view of the retractile pen of FIG. 1 in a fully retracted state for storage.

FIG. 2 is an assembled perspective view of the retractile pen 1 of FIG. 1. Please refer to FIGS. 2 and 4 at the same time. When the push button 50 is depressed and slid rearward to locate the expanded head 52 at a rear end of the first guide slot 11 on the clip 10 and then released, the stub 42 on the top of the retaining bolt 40 is elastically projected into and held to the locating slot 22 at a rear end of the second guide slot 21 on the outer barrel 20, causing the inner barrel 30 to stay in the outer barrel 20. At this point, the writing tip 32 is in a retracted position to completely locate in the outer barrel 20 for storage.

Figure 5:
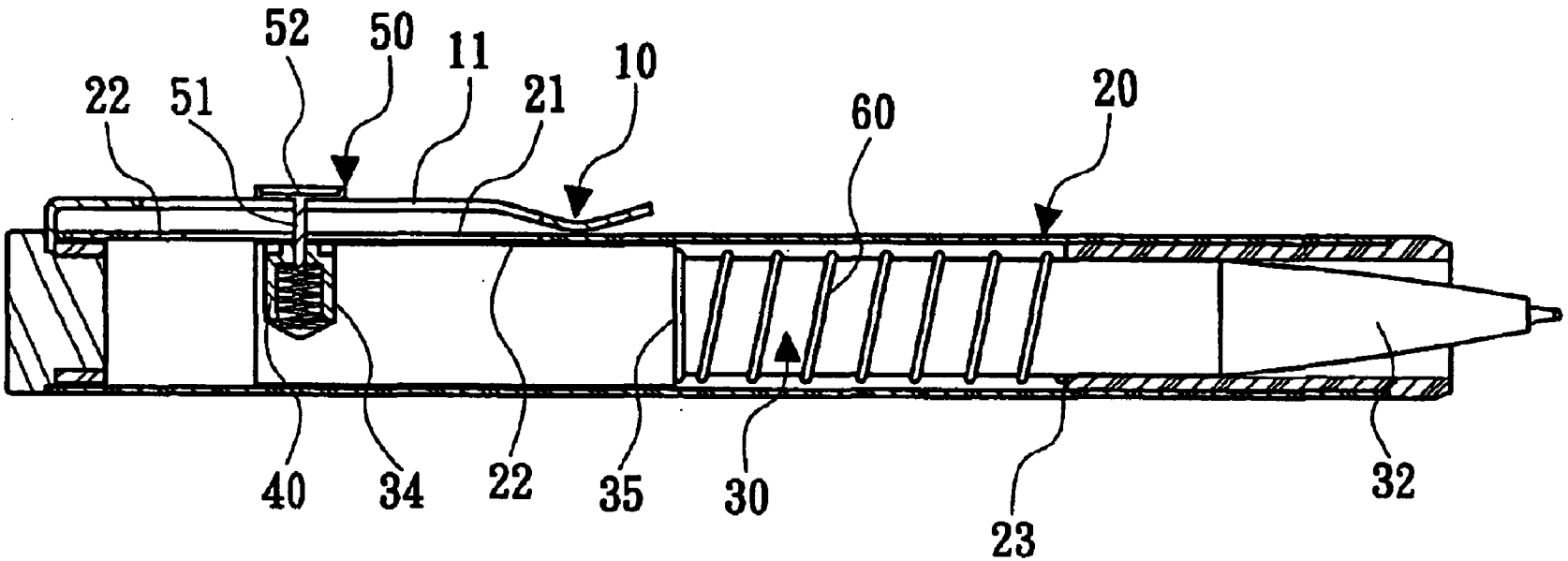
FIG. 5 shows the retractile pen of FIG. 4 in a partially extended state.

Please refer to FIG. 5 now. When the push button 50 is downward pushed at the expanded head 52, the retaining bolt 40 is moved downward accordingly to disengage the stub 42 from the locating slot 22 near the rear end of the outer barrel 20. At this point, the push button 50 may be slid forward along the first and the second guide slot 11, 21 to move the inner barrel 30 forward via the engaged connecting bar 51 and retaining bolt 40, and the writing tip 32 is therefore gradually exposed from the front end of the outer barrel 20. Meanwhile, the compression spring 60 is compressed between the first shoulder portion 35 on the forward moved inner barrel 30 and the second shoulder portion 23 on the outer barrel 20.

Figure 3:
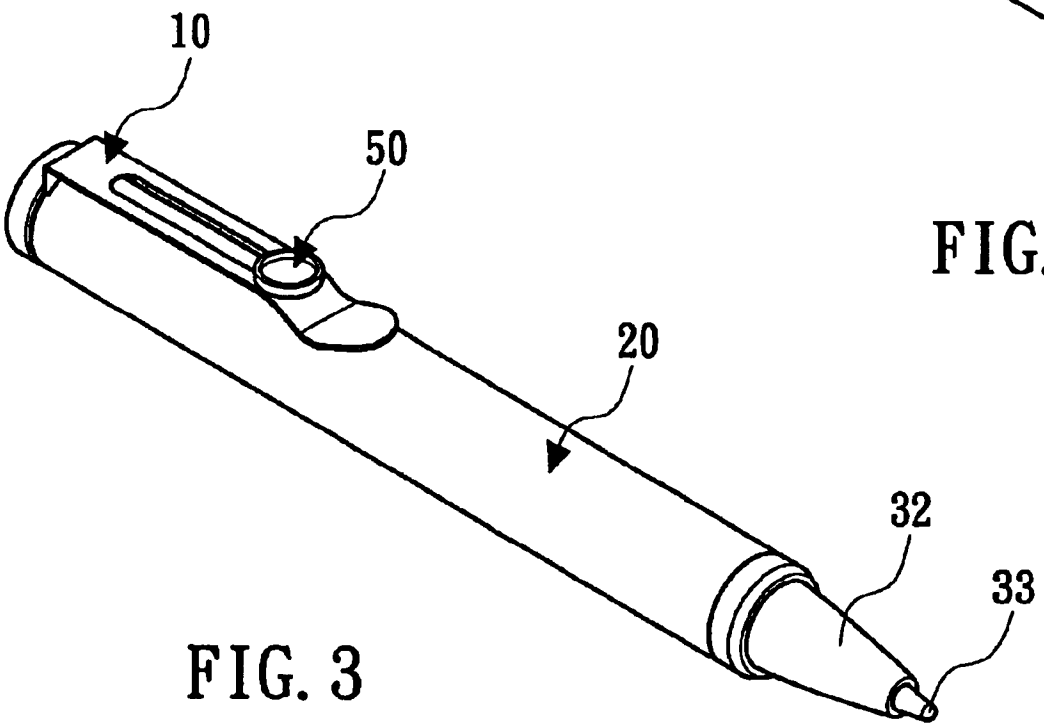
FIG. 3 is an assembled perspective view of the retractile pen of FIG. 1 in a fully extended state for writing.
Figure 6:
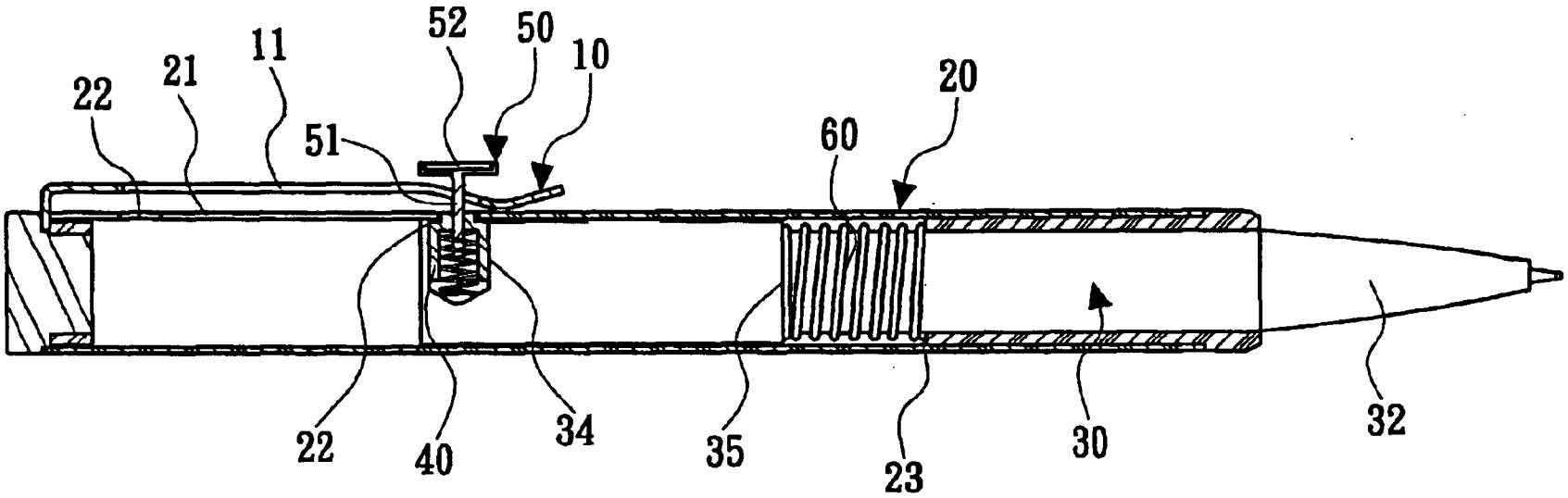
FIG. 6 is a partially sectioned side view of FIG. 3.

Please refer to FIGS. 3 and 6 that are perspective and sectioned side views, respectively, of the retractile pen 1 with the inner barrel 30 in a fully extended position. When the push button 50 is downward pushed and slid along the first guide slot 11 on the clip 10 to locate the expanded head 52 at a front end of the first guide slot 11 and then released, the retaining bolt 40 is pushed upward by the spring 41, causing the stub 42 to extend into and be held to the locating slot 22 at a front end of the second guide slot 22. At this point, the inner barrel 30 is held to a fully extended position to completely project the writing tip 32 from the front end of the outer barrel 20 for writing.

To return the inner barrel 30 from the extended position for writing to the retracted position for storage, simply push the push button 50 downward and slide it toward the rear end of the pen 1 and then release it. The restoring force generated by the compression spring 60 in the compressed state allows the inner barrel 30 to retract easier.

When the retractile pen 1 is in the extended position for writing as shown in FIGS. 3 and 6, the stub 42 of the retaining bolt 40 is held to the locating slot 22 at the front end of the second guide slot 21 on the outer barrel 20 and the push button 50 is held to the front end of the first guide slot 11. That is, the connecting bar 51 of the push button 50 is vertically located near a front end of the clip 10 to lock the clip 10 to the outer barrel 20. That is, when the inner barrel 30 is in the extended position, it would be impossible to clamp the retractile pen 1 to a pocket with the locked clip 10. The user is therefore reminded of the extended inner barrel 30 and accordingly the exposed ink cartridge 33 and writing tip 32 to avoid making an ink spot on the pocket. The retractile pen 1 therefore has a simple but effective structure to avoid making any undesired ink spot on the user's cloth.

For a user to comfortably push and slide the push button 50, the expanded head 52 is actually an important part of the push button 50 and therefore designed to have dimensions and configurations meeting the requirements of body engineering. Moreover, different patterns, designs, and letters may be provided on the expanded head 52 as advertising means.

Figure 7:
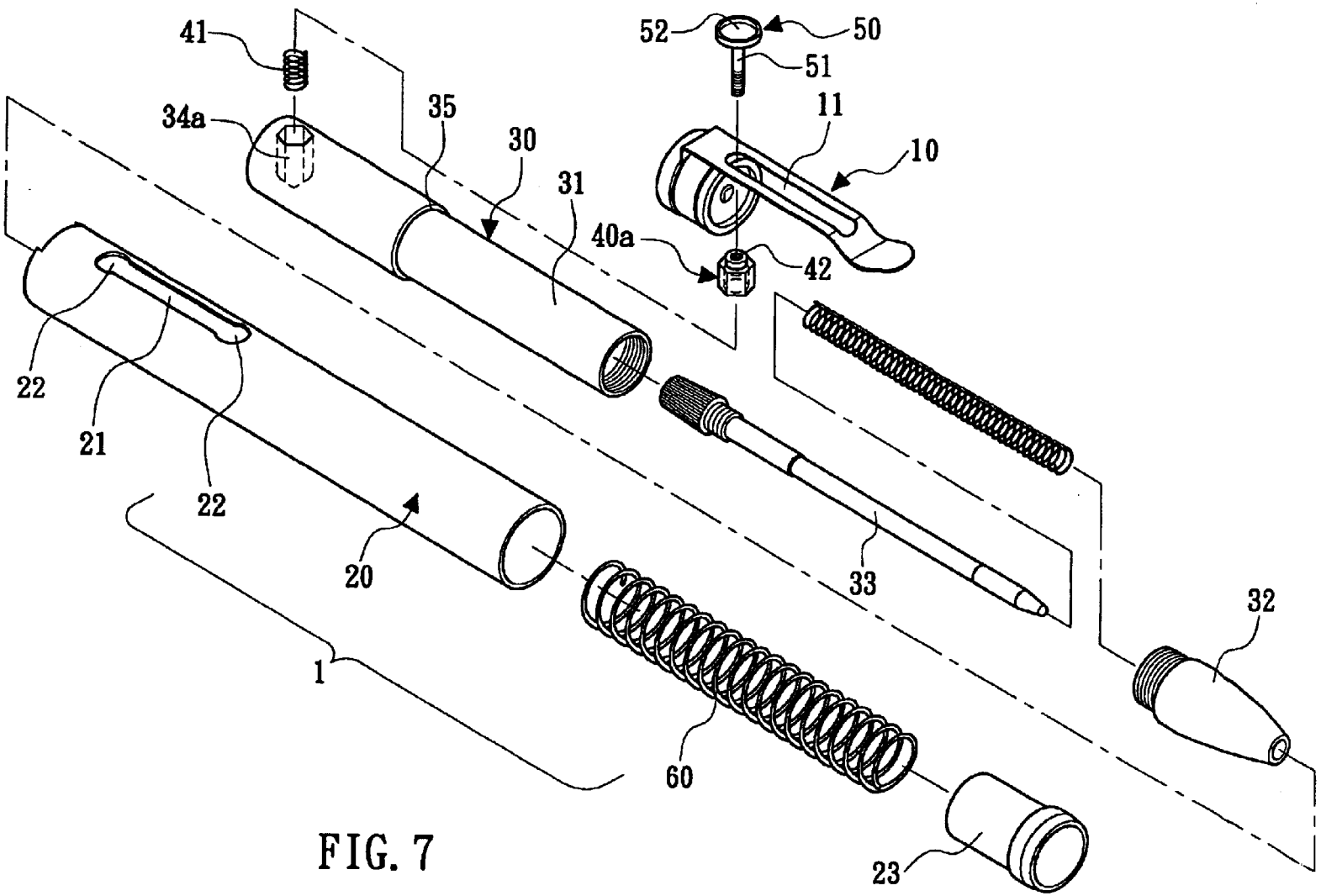
FIG. 7 is an exploded perspective view of a retractile pen according to a second embodiment of the present invention.

FIG. 7 is an exploded perspective view of a retractile pen 1 according to a second embodiment of the present invention. The second embodiment is generally structurally similar to the first embodiment, except that it has a hexagonal retaining hole 34*a* and a corresponding hexagonal retaining bolt 40*a*. With the hexagonal retaining hole 34*a* and retaining bolt 40*a*, the expanded head 52 of the push button 50 may be always oriented to a fixed direction without being turned relative to the outer barrel 20. In this manner, the advertising patterns, designs, or letters provided on the expanded head 52 may be best shown.

Figure 9:
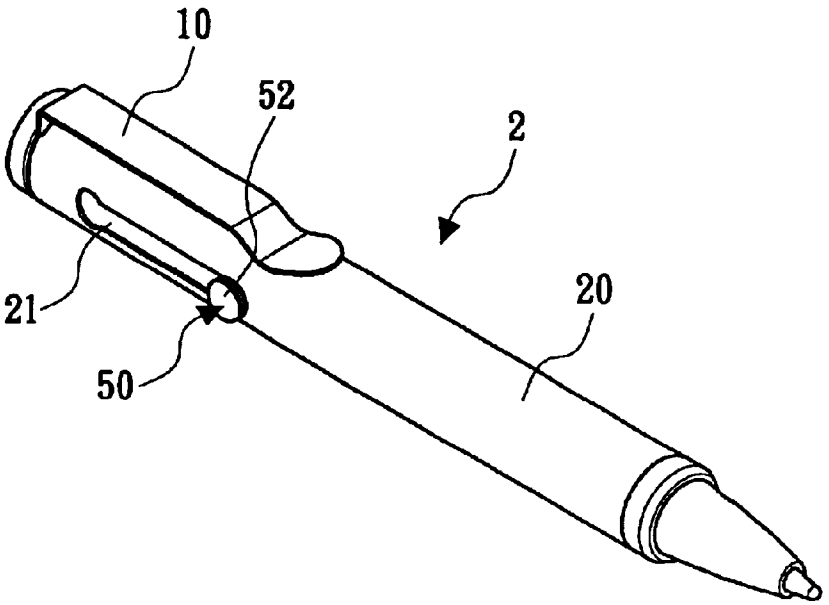
FIG. 9 is the retractile pen of FIG. 8 in an extended state for writing.
Figure 8:
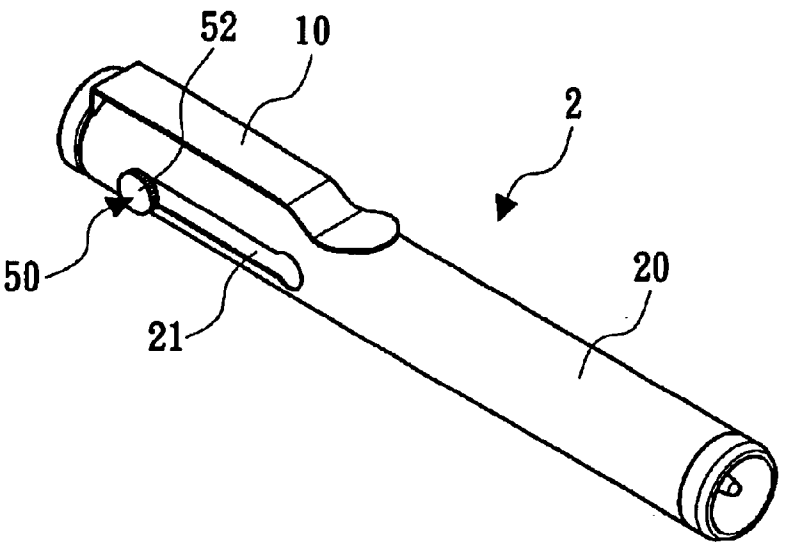
FIG. 8 is an assembled perspective view of a retractile pen according to a third embodiment of the present invention having a simplified retracting structure, wherein the retractile pen is in a retracted state for storage.

In FIGS. 8 and 9, there is shown a retractile pen 2 according to a third embodiment of present invention having a simplified structure as compared with the retractile pen 1. In this third embodiment, the first guide slot 11 is omitted from the clip 10, the second guide slot 21 is provided on the outer barrel 20 offset from the clip 10, and the connecting bar 51 of the push button 50 is shortened for the expanded head 52 to straddle an outer side of the second guide slot 21. The retractile pen 2 is operated in the same manner as that of the retractile pen 1 to extend or retract the inner barrel. However, since the clip 10 of the retractile pen 2 is not locked to the outer barrel 20 when the inner barrel is in the extended position as shown in FIG. 9, the retractile pen 2 does not provide the function of reminding a user of an exposed writing tip and avoiding making an ink spot on the user's cloth.

What is claimed is:

1. A retractile pen, comprising a clip, an outer barrel, and an inner barrel;

said clip being fixedly fitted to a rear end of said outer barrel, and having a longitudinally extended first guide slot provided thereat;

said outer barrel being provided near the rear end with a second guide slot corresponding to said first guide slot on said clip, and front and rear ends of said second guide slot having increased width to provide two locating slots; and said inner barrel being movably put in said outer barrel and including a cylindrical tube, an ink cartridge mounted in said cylindrical tube, and a writing tip connected to a front end of said cylindrical tube for a front point of said ink cartridge to expose therefrom; said inner barrel having an overall length shorter than said outer barrel and being provided near a rear end of said cylindrical tube with a retaining hole for receiving a spring and a retaining bolt therein, such that said retaining bolt is normally radially pushed outward by said spring; said retaining bolt having a stepped upper portion to provide a size-reduced stub adapted to detachably extend into said locating slots at two ends of said second guide slot on said outer barrel and be held thereto; and said stub being connected to a push button, said push button including an expanded head and a connecting bar downward extended from a bottom center of said expanded head, and said connecting bar being extended through said first guide slot on said clip to connect to said stub with said expanded head located above said clip to straddle said first guide slot;

whereby when said push button is downward pushed and slid along said first guide slot, said retaining bolt is brought to move along said second guide slot on said outer barrel and be held to said locating slots at the front or the rear end of said second guide slot, so that said inner barrel is extended from or retracted into said outer barrel, respectively, for writing or storage.

2. The retractile pen as claimed in claim 1, wherein said connecting bar of said push button moved to the front end of said first guide slot is vertically located near a front end of said clip to lock said clip to said outer barrel.

3. The retractile pen as claimed in claim 1, wherein said stub of said retaining bolt is internally threaded, and said connecting bar of said push button is externally threaded for screwing to said internally threaded stub.

4. The retractile pen as claimed in claim 1, wherein said inner barrel is provided near the rear end with a first shoulder portion and said outer barrel is provided near a front end with a second shoulder portion for holding a compression spring around said inner barrel between said first and said second shoulder portion.

5. The retractile pen as claimed in claim 1, wherein said expanded head of said push button may be differently configured.

6. The retractile pen as claimed in claim 1, wherein said expanded head of said push button has patterns provided thereon.

7. The retractile pen as claimed in claim 1, wherein said retaining hole and said retaining bolt have a round cross section.

8. The retractile pen as claimed in claim 1, wherein said retaining hole and said retaining bolt have a hexagonal cross section.

9. A retractile pen, comprising a clip, an outer barrel, and an inner barrel;

said clip being fixedly fitted to a rear end of said outer barrel;

said outer barrel being provided near the rear end with a guide slot offset from said clip, and front and rear ends of said guide slot having increased width to provide two locating slots; and said inner barrel being movably put in said outer barrel and including a cylindrical tube, an ink cartridge mounted in said cylindrical tube, and a writing tip connected to a front end of said cylindrical tube for a front point of said ink cartridge to expose therefrom; said inner barrel having an overall length shorter than said outer barrel and being provided near a rear end of said cylindrical tube with a retaining hole for receiving a spring and a retaining bolt therein, such that said retaining bolt is normally radially pushed outward by said spring; said retaining bolt having a stepped upper portion to provide a size-reduced stub adapted to detachably extend into said locating slots at two ends of said guide slot on said outer barrel and be held thereto; and said stub being connected to a push button, said push button including an expanded head and a connecting bar downward extended from a bottom center of said expanded head, and said connecting bar being connected to said stub with said expanded head located above said outer barrel to straddle said guide slot;

whereby when said push button is downward pushed and slid along said guide slot, said retaining bolt is brought to move along said guide slot and be held to said locating slots at the front or the rear end of said guide slot, so that said inner barrel is extended from or retracted into said outer barrel, respectively, for writing or storage.

10. The retractile pen as claimed in claim 9, wherein said stub of said retaining bolt is internally threaded, and said connecting bar of said push button is externally threaded for screwing to said internally threaded stub.

11. The retractile pen as claimed in claim 9, wherein said inner barrel is provided near the rear end with a first shoulder portion and said outer barrel is provided near a front end with a second shoulder portion for holding a compression spring around said inner barrel between said first and said second shoulder portion.

12. The retractile pen as claimed in claim 9, wherein said expanded head of said push button may be differently configured.

13. The retractile pen as claimed in claim 9, wherein said expanded head of said push button has patterns provided thereon.

14. The retractile pen as claimed in claim 9, wherein said retaining hole and said retaining bolt have a round cross section.

15. The retractile pen as claimed in claim 9, wherein said retaining hole and said retaining bolt have a hexagonal cross section.

* * * * *